US011421422B2

(12) United States Patent
Zhao et al.

(10) Patent No.: US 11,421,422 B2
(45) Date of Patent: Aug. 23, 2022

(54) MULTI-BLADE TOP AWNING CAPABLE OF BEING OPENED/CLOSED BIDIRECTIONALLY BY 360 DEGREES

(71) Applicant: ZHEJIANG LINYA CO., LTD, Zhejiang (CN)

(72) Inventors: Nlangao Zhao, Zhejiang (CN); Minjian Jiang, Zhejiang (CN)

(73) Assignee: ZHEJIANG LINYA CO., LTD, Zhejiang (CN)

( * ) Notice: Subject to any disclaimer, the term of this patent is extended or adjusted under 35 U.S.C. 154(b) by 16 days.

(21) Appl. No.: 17/033,884

(22) Filed: Sep. 27, 2020

(65) Prior Publication Data

US 2021/0010270 A1 Jan. 14, 2021

(30) Foreign Application Priority Data

Aug. 13, 2020 (CN) ..... 202010812052.4

(51) Int. Cl.
*E04F 10/10* (2006.01)
*E04B 1/16* (2006.01)
*E04H 1/12* (2006.01)

(52) U.S. Cl.
CPC ..... *E04F 10/10* (2013.01); *E04B 1/163* (2013.01); *E04H 1/1205* (2013.01)

(58) Field of Classification Search
CPC ..... E04F 10/10; E04F 10/08; E04F 10/005; E04H 1/1205; E04B 7/163; E04B 7/166; E04D 13/04; E04D 11/00; B60J 7/0084
See application file for complete search history.

(56) References Cited

U.S. PATENT DOCUMENTS 3,460,289 A * 8/1969 Toth ..... E06B 7/084 49/50
4,527,355 A * 7/1985 Numakami ..... E04F 10/10 49/275
8,756,873 B1 * 6/2014 Hire ..... E04F 10/10 52/72
10,851,544 B1 * 12/2020 Volin ..... B60J 7/0084
2003/0050159 A1 * 3/2003 Kato ..... B23Q 5/341 483/3

* cited by examiner

*Primary Examiner* — Brian D Mattei
*Assistant Examiner* — Omar F Hijaz
(74) *Attorney, Agent, or Firm* — JCIP Global Inc.

(57) ABSTRACT

A multi-blade top awning includes an awning frame. A blade top plate, a linkage strip for driving the blade top plate to be opened/closed and a driving mechanism are cooperatively mounted on the awning frame. The driving mechanism includes a connection rod, a rocker arm, a worm and gear assembly and a power source. The connection rod is used for driving the linkage strip to move, the rocker arm is used for driving the connection rod to move, the worm and gear assembly is used for driving the rocker arm to rotate, and the power source is used for providing power for the worm and gear assembly. The rocker arm can rotate by 360 degrees around the worm and gear assembly, such that the blade top plate is opened/closed, a manual rocker does not need to be rotated in a reverse direction when the blade top plate is closed.

16 Claims, 12 Drawing Sheets

MULTI-BLADE TOP AWNING CAPABLE OF BEING OPENED/CLOSED BIDIRECTIONALLY BY 360 DEGREES

CROSS-REFERENCE TO RELATED APPLICATION

This application claims the priority benefit of China application serial no. 202010812052.4, filed on Aug. 13, 2020. The entirety of the above-mentioned patent application is hereby incorporated by reference herein and made a part of this specification.

BACKGROUND

Technical Field

The present invention belongs to the field of outdoor articles, and particularly relates to a multi-blade top awning capable of being opened/closed bidirectionally by 360 degrees.

Description of Related Art

An awning generally includes an awning frame, a blade top plate, a linkage strip, a driving mechanism and the like. The transmission relation of the above components is that the driving mechanism drives the linkage strip to move, and the linkage strip drives the blade top plate to be opened.

A traditional awning opens the blade top plate in a forward and reverse rotation mode. For example, if the blade top plate is opened by means of forward rotation and closed by means of reverse rotation, a situation that sometimes a user operates improperly and the blade top plate continues to rotate reversely under the condition that the blade top plate has been closed tightly may occur, and then a shutter transmission mechanism, the blade top plate and other components interfere and collide with one another and are prone to damage.

SUMMARY

In order to make up for the deficiencies of the prior art, the present invention provides a multi-blade top awning capable of being opened/closed bidirectionally by 360 degrees.

The multi-blade top awning capable of being opened/closed bidirectionally by 360 degrees includes an awning frame, a blade top plate, a linkage strip used for driving the blade top plate to be opened/closed and a driving mechanism being cooperatively mounted on the awning frame, and is characterized in that the driving mechanism includes a connection rod, a rocker arm, a worm and gear assembly and a power source, the connection rod is used for driving the linkage strip to move, the rocker arm is used for driving the connection rod to move, the worm and gear assembly is used for driving the rocker arm to rotate, the power source is used for providing power for the worm and gear assembly, and the rocker arm may drive the connection rod to reciprocate by means of one-way continuous rotation so as to open/close the blade top plate. When the rocker arm and the connection rod are in a parallel or overlapped state, the blade top plate is completely opened or completely closed.

In an embodiment of the invention, one end of the connection rod is rotatably mounted on the linkage strip, the other end thereof is rotatably mounted on the rocker arm, and the rocker arm is in transmission fit with an output shaft of the worm and gear assembly.

In an embodiment of the invention, the connection rod is rotatably mounted on the linkage strip by means of a connection rod shaft arranged on the connection rod.

In an embodiment of the invention, the rocker arm may drive the connection rod to reciprocate by means of one-way rotation, and when an angle between the rocker arm and the connection rod is 0 degree, the connection rod drives the blade top plate to be in a completely opened state by means of the linkage strip. When the angle between the rocker arm and the connection rod is 180 degrees, the connection rod drives the blade top plate to be in a completely closed state by means of the linkage strip.

In an embodiment of the invention, the awning frame includes a plurality of stand columns and a ring beam set cooperatively mounted at upper ends of the stand columns, the ring beam set includes first ring beams at front and rear ends of the awning frame and second ring beams at left and right ends of the awning frame, and the stand column and the corresponding first ring beam and/or second ring beam are cooperatively mounted by means of fasteners in a horizontal direction and a vertical direction.

In an embodiment of the invention, a first mounting plate and a second mounting plate fixedly match an end plate of the stand column, two ring beams and the end plate of the stand column are cooperatively mounted by means of vertically-arranged screws, a side surface of the first ring beam and the first mounting plate are cooperatively mounted by means of horizontally-arranged screws, and a side surface of the second ring beam and the second mounting plate are cooperatively mounted by means of the horizontally-arranged screws.

In an embodiment of the invention, the first ring beam and/or the second ring beam is fixedly provided with a beam water groove, and the beam water groove and the stand column are cooperatively mounted by means of the fasteners. The end plate of the stand column is provided with a water falling opening corresponding to the beam water groove.

In an embodiment of the invention, the beam water groove and the end plate of the stand column are cooperatively mounted by means of the vertically-arranged screws.

In an embodiment of the invention, inner ends of two ring beams abut against each other.

In an embodiment of the invention, a blade end cover is cooperatively mounted at an end part of the blade top plate, one end of the blade end cover is rotatably mounted on the awning frame, and the other end thereof is rotatably mounted on the linkage strip. A water retaining strip is cooperatively mounted on one side of an upper end of the awning frame.

Compared with the prior art, the rocker arm in the present invention can continuously rotate by 360 degrees around the worm and gear assembly, such that the blade top plate is continuously opened/closed, a manual rocker does not need to be rotated in a reverse direction when the blade top plate is closed, and the present invention can be prevented from being damaged during closing and can be opened/closed no matter whether the present invention rotates forwards or reversely, which is quite smooth and practical. The ring beam and the stand column in the present invention are fastened by means of the screws in the horizontal direction and in the vertical direction, the connection reliability between the ring beam and the stand column is enhanced by means of the double-fastening structure, no angle iron and other structures need to be additionally arranged, and therefore, the present invention has the advantages of being reliable in connection, convenient to mount and capable of saving cost.

DESCRIPTION OF THE EMBODIMENTS

Figure 1:
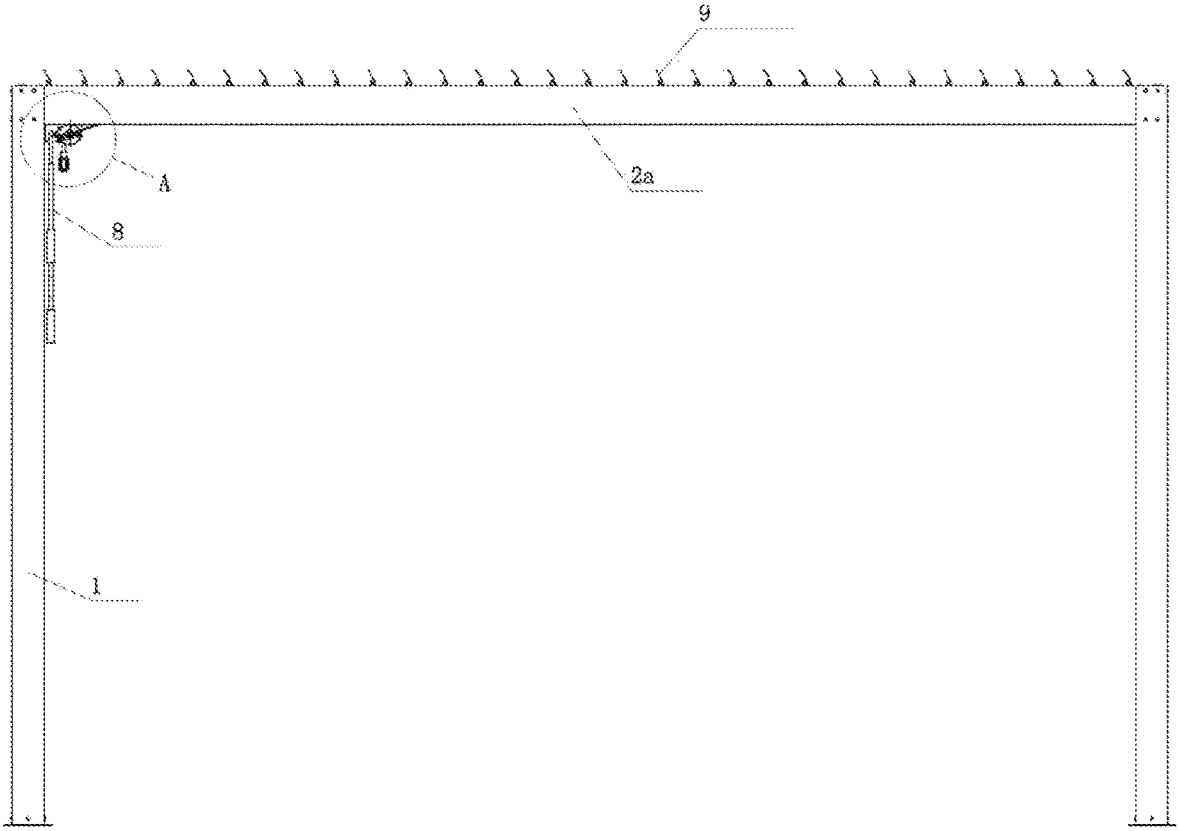
FIG. 1 is a front-view structural schematic diagram of the present invention.
Figure 2:
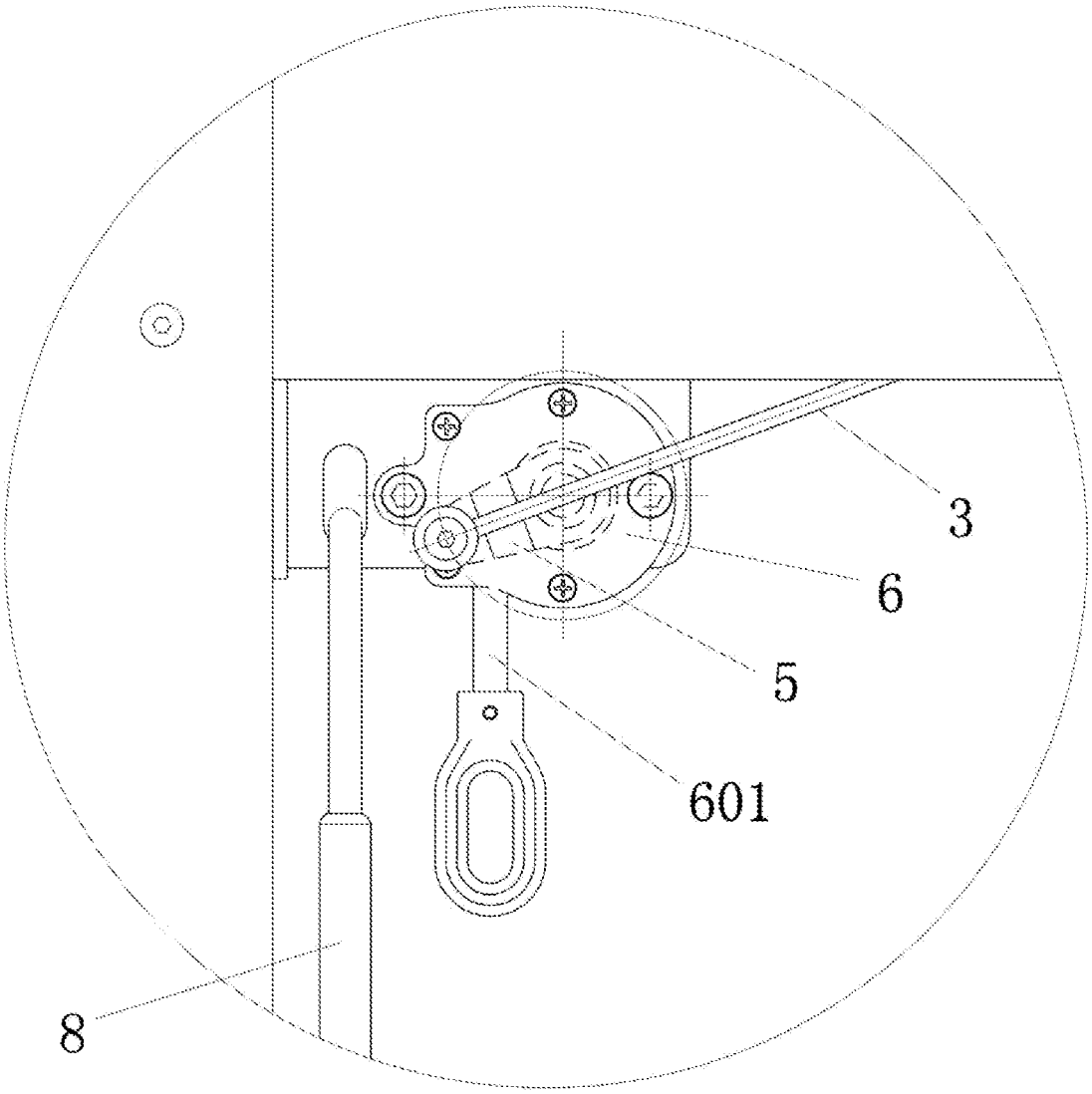
FIG. 2 is an enlarged diagram of region A in FIG. 1.

The present invention will be further elaborated hereafter in conjunction with the accompanying drawings.

As shown in the figures, a multi-blade top awning capable of being opened/closed bidirectionally by 360 degrees includes an awning frame. A blade top plate 9, a linkage strip 4 used for driving the blade top plate 9 to be opened/closed and a driving mechanism are cooperatively mounted on the awning frame. The driving mechanism includes a connection rod 3, a rocker arm 5, a worm and gear assembly 6 and a power source. The connection rod 3 is used for driving the linkage strip 4 to move, the rocker arm 5 is used for driving the connection rod 3 to move, the worm and gear assembly 6 is used for driving the rocker arm 5 to rotate, the power source is used for providing power for the worm and gear assembly 6, and the rocker arm 5 may drive the connection rod 3 to reciprocate by means of one-way continuous rotation so as to open/close the blade top plate 9. When the rocker arm 5 and the connection rod 3 are in a parallel or overlapped state, the blade top plate 9 is completely opened or completely closed. The parallel or overlapped state refers to that the rocker arm 5 and the connection rod 3 are generally in a coplanar state and are conventionally in a coaxial state or the coplanar state.

In one embodiment of the present invention, the rocker arm 5 may drive the connection rod 3 to reciprocate by means of one-way rotation, and when an angle between the rocker arm 5 and the connection rod 3 is 0 (zero) degree, the connection rod 3 drives the blade top plate 9 to be in a completely opened state by means of the linkage strip 4. When the angle between the rocker arm 5 and the connection rod 3 is 180 degrees, the connection rod 3 drives the blade top plate 9 to be in a completely closed state by means of the linkage strip 4. The angle between the rocker arm 5 and the connection rod 3 is an angle between a center line of the rocker arm 5 and an axis of the connection rod 3, 0 degree means that the rocker arm 5 coincides with the connection rod 3 and that the distance between a rotation center axis of the rocker arm 5 and a connection rod shaft 7 mentioned below is the smallest at the moment, and 180 degrees means that the rocker arm 5 and the connection rod 3 are unfolded and connected into a straight line and that the distance between the rotation center axis of the rocker arm 5 and the connection rod shaft 7 is the largest at the moment.

In another embodiment of the present invention, when an angle between the rocker arm 5 and the connection rod 3 is 0 degree, the connection rod 3 drives the blade top plate 9 to be in a completely closed state by means of the linkage strip 4. When the angle between the rocker arm 5 and the connection rod 3 is 180 degrees, the connection rod 3 drives the blade top plate 9 to be in a completely opened state by means of the linkage strip 4. The angle between the rocker arm 5 and the connection rod 3 is an angle between a center line of the rocker arm 5 and an axis of the connection rod 3, 0 degree means that the rocker arm 5 coincides with the connection rod 3 and that the distance between a rotation center axis of the rocker arm 5 and a connection rod shaft 7 is the smallest at the moment, and 180 degrees means that the rocker arm 5 and the connection rod 3 are unfolded and connected into a straight line and that the distance between the rotation center axis of the rocker arm 5 and the connection rod shaft 7 is the largest at the moment.

The difference between the two embodiments mentioned above lies in the adjustment of the positional relationship between the linkage strip 4 and the blade top plate 9.

As a structural optimization of the driving mechanism in the present invention: one end of the connection rod 3 is rotatably mounted on the linkage strip 4, and the other end of the connection rod 3 is rotatably mounted on the rocker arm 5. More specifically, the connecting rod 3 is rotatably mounted on the linkage strip 4 by means of the arranged connection rod shaft 7.

As a structural optimization of the driving mechanism in the present invention: the rocker arm 5 is in transmission fit with an output shaft 600 of the worm and gear assembly 6, for example, the rocker arm and the output shaft are in fixed fit or in key fit.

As a structural optimization of the driving mechanism in the present invention: the power source is a manual rocker 8, and more specifically, the manual rocker 8 is in hanging transmission fit with an input shaft 601 of the worm and gear assembly 6.

In the present invention, the structure of the worm and gear assembly 6 mentioned above is the prior art and includes a housing, a worm gear, a worm and a worm gear shaft. The worm serves as the input shaft 601 of the worm and gear assembly 6, and an annular structure is arranged at a lower end of the worm and can be used for hanging the manual rocker 8, such that the manual rocker 8 can conveniently drive the input shaft 601 to rotate, and the worm gear shaft serves as an output shaft 600 of the worm and gear assembly 6.

As a structural optimization of the blade top plate in the present invention: a blade end cover 10 is cooperatively mounted at an end part of the blade top plate 9, one end of the blade end cover 10 is rotatably mounted on the awning frame, and the other end of the blade end cover 10 is rotatably mounted on the linkage strip 4. Specifically, the blade end cover 10 is sleeved with the middle of the end part of the blade top plate 9, one side of the blade top plate 9 is clamped into a clamping groove 1000 of the blade end cover 10 by means of a clamping rib 900, the other side of the blade top plate 9 is buckled to a limiting opening 1001 of the blade end cover 10 by means of a limiting edge 901. The side, provided with the clamping rib 900, of the blade top plate 9 extends to form a water collection groove 902, and the water collection groove 902 is supported on the blade end cover 10 and is positioned by means of the connection between the clamping rib 900 and the clamping groove 1000.

As a structural optimization of the awning frame in the present invention: the awning frame includes four stand columns 1 and a ring beam set cooperatively mounted at upper ends of the stand columns 1. The ring beam set includes first ring beams 2*a* at front and rear ends of the awning frame and second ring beams 2*b* at left and right ends of the awning frame. The stand column 1 and the corresponding first ring beam 2*a* and/or second ring beam 2*b* are cooperatively mounted by means of fasteners in a horizontal direction and a vertical direction. The first ring beams 2*a* are front and rear beams, and the second ring beams 2*b* are side beams.

As a structural optimization of the awning frame in the present invention: a first mounting plate 101 and a second mounting plate 102 fixedly match an end plate 100 of the stand column 1, two ring beams and the end plate 100 of the stand column 1 are cooperatively mounted by means of vertically-arranged screws, a side surface of the first ring beam 2*a* and the first mounting plate 101 are cooperatively mounted by means of horizontally-arranged screws, and a side surface of the second ring beam 2*b* and the second mounting plate 102 are cooperatively mounted by means of the horizontally-arranged screws.

In the above optimized structure, the first mounting plate 101 and the second mounting plate 102 fixedly match to form a right-angle structure corresponding to two ring beams, and two mounting plates and the stand column 1 are of an integrated structure.

As a structural optimization of the awning frame in the present invention: beam water grooves 200 are fixedly mounted on the sides, facing a center of the awning, of the first ring beam 2*a* and the second ring beam 2*b* in a length direction, and the beam water groove 200 and the stand column 1 are cooperatively mounted by means of the fasteners.

The above optimized structure is further described: the beam water groove 200 and the end plate 100 of the stand column 1 are cooperatively mounted by means of the vertically-arranged screws. The end plate 100 of the stand column 1 is provided with a water falling opening 1000 corresponding to the beam water groove 200.

Figure 3:
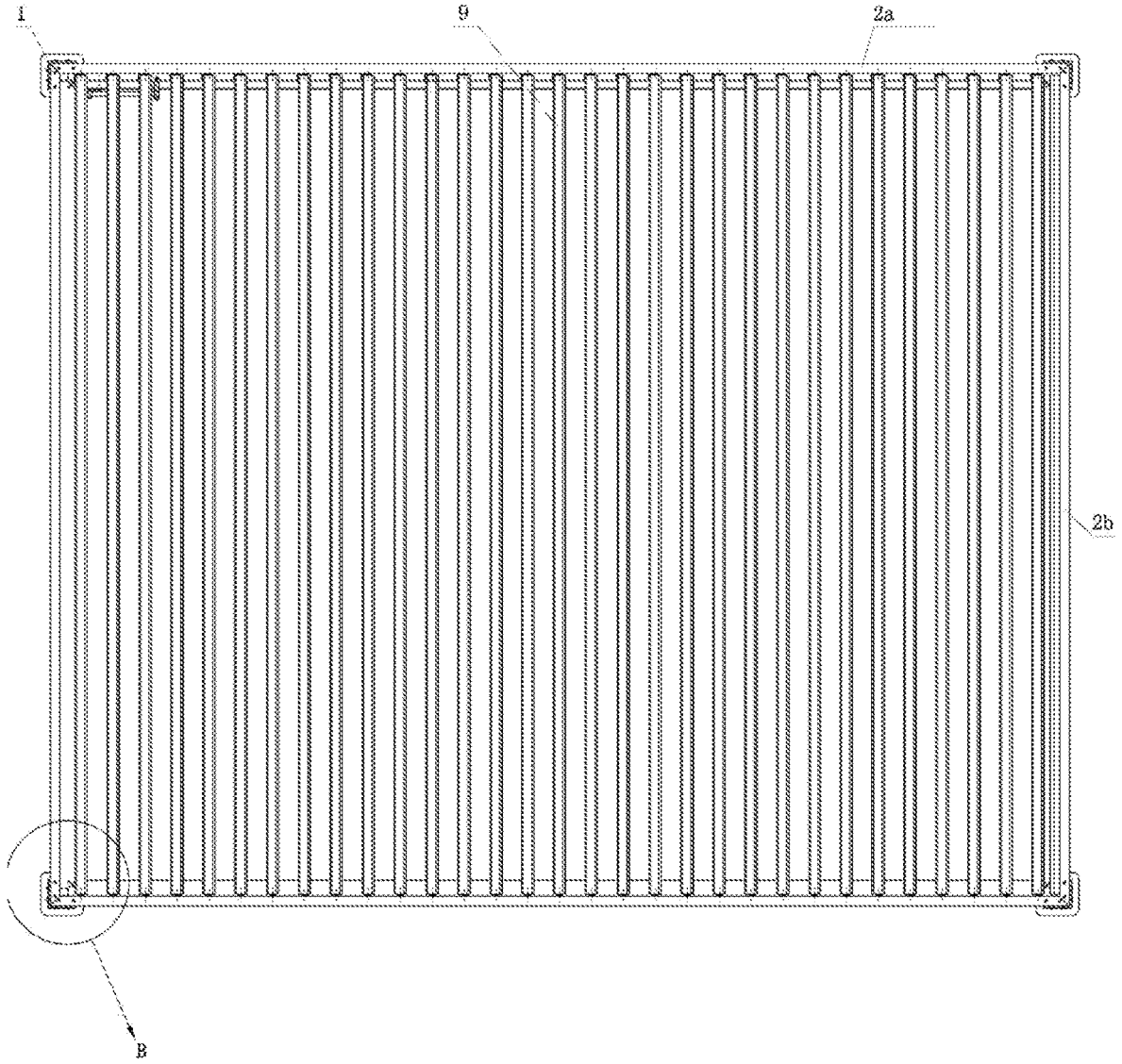
FIG. 3 is a top-view structural schematic diagram of the present invention.
Figure 4:
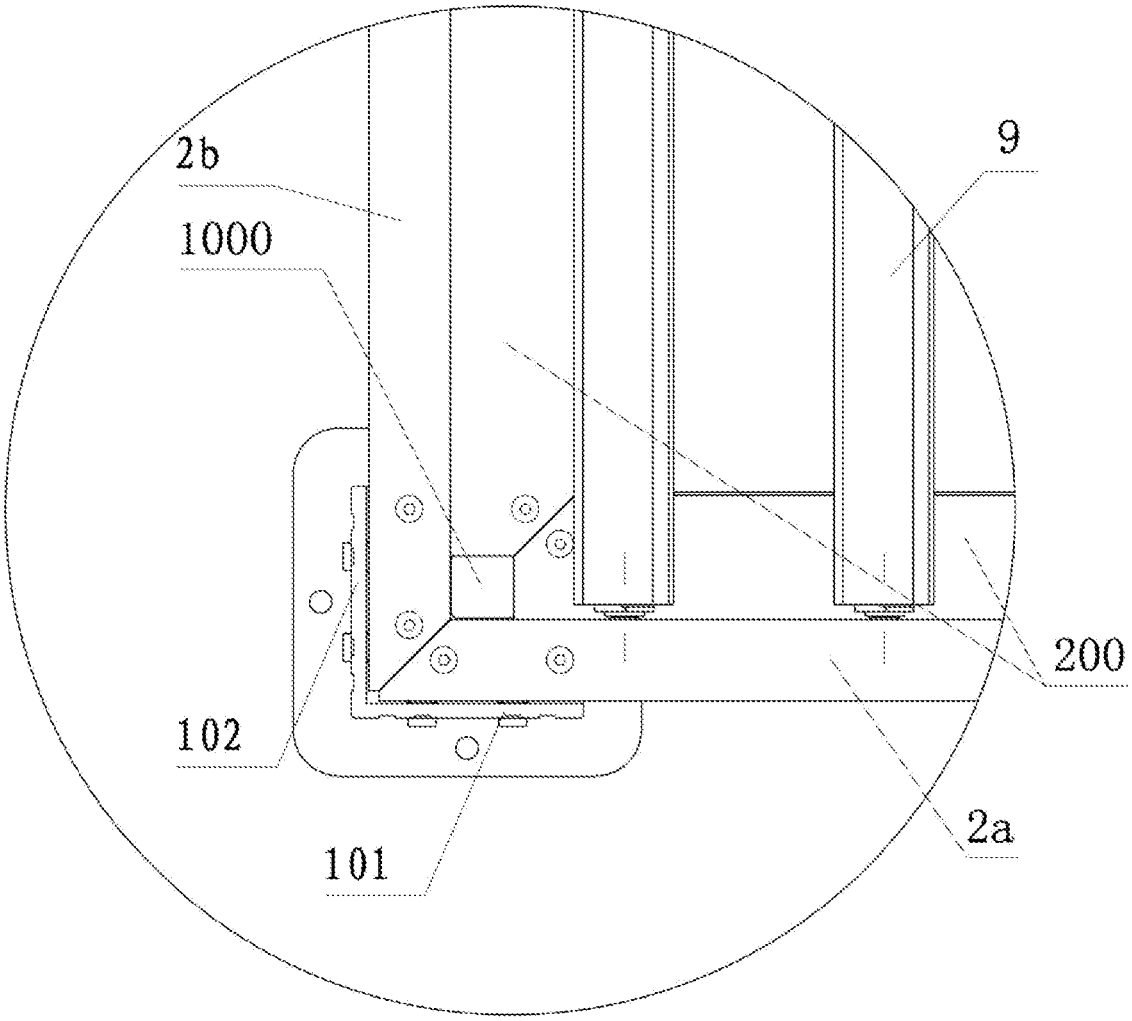
FIG. 4 is an enlarged diagram of region B in FIG. 3.
Figure 5:
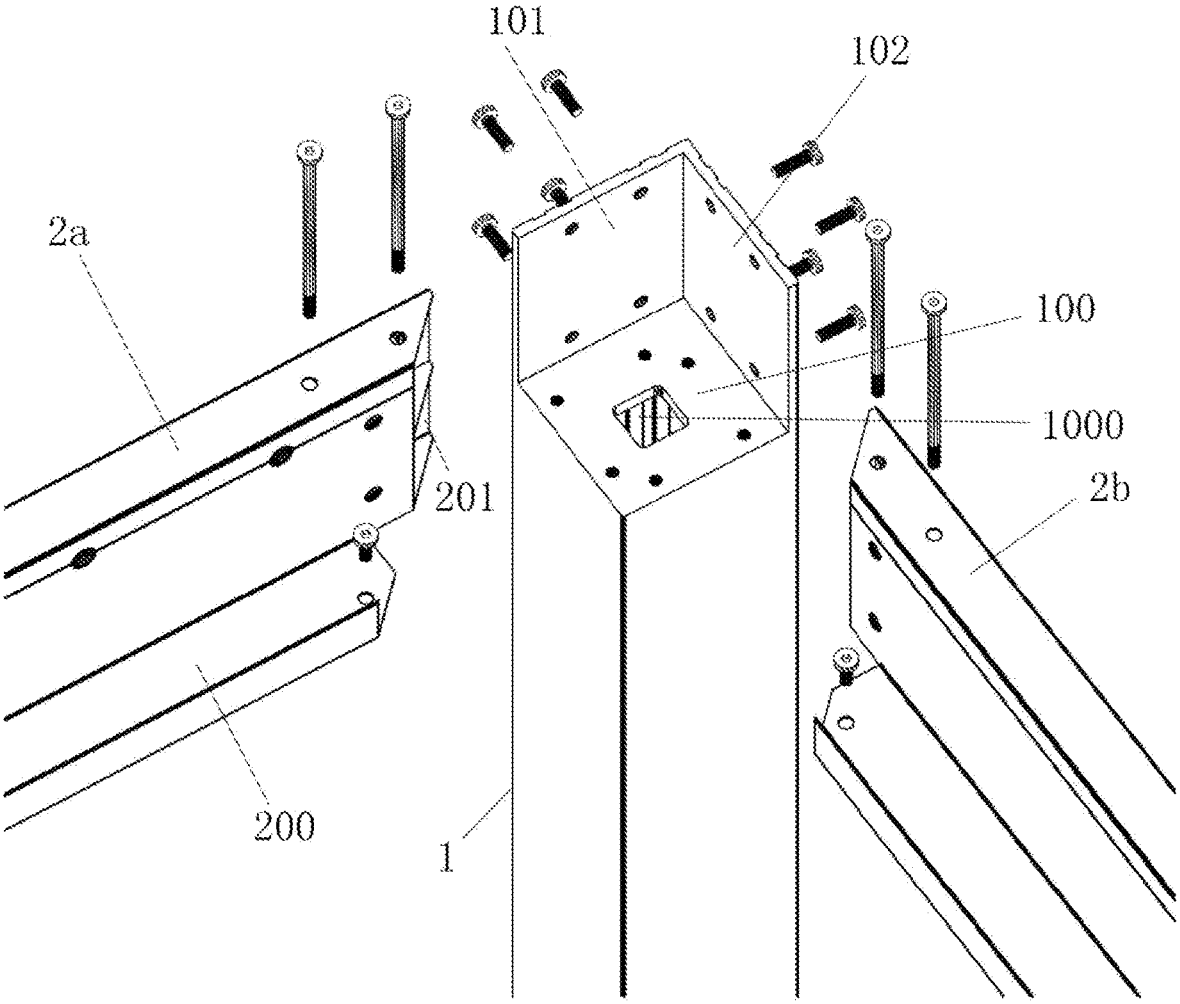
FIG. 5 is a structural schematic diagram of connection between a stand column and a ring beam set in the present invention.
Figure 6:
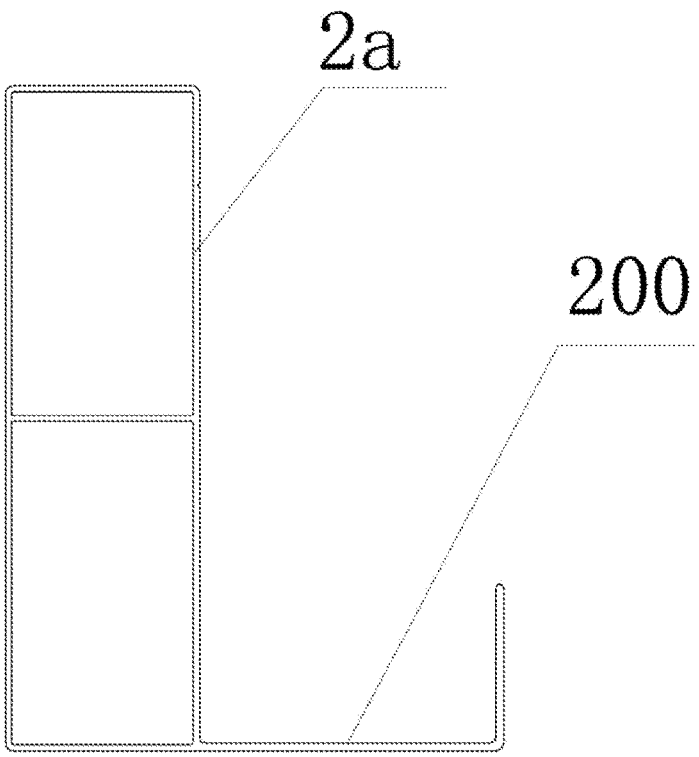
FIG. 6 is a schematic diagram of end surface structures of a first ring beam and a beam water groove in the present invention.
Figure 7:
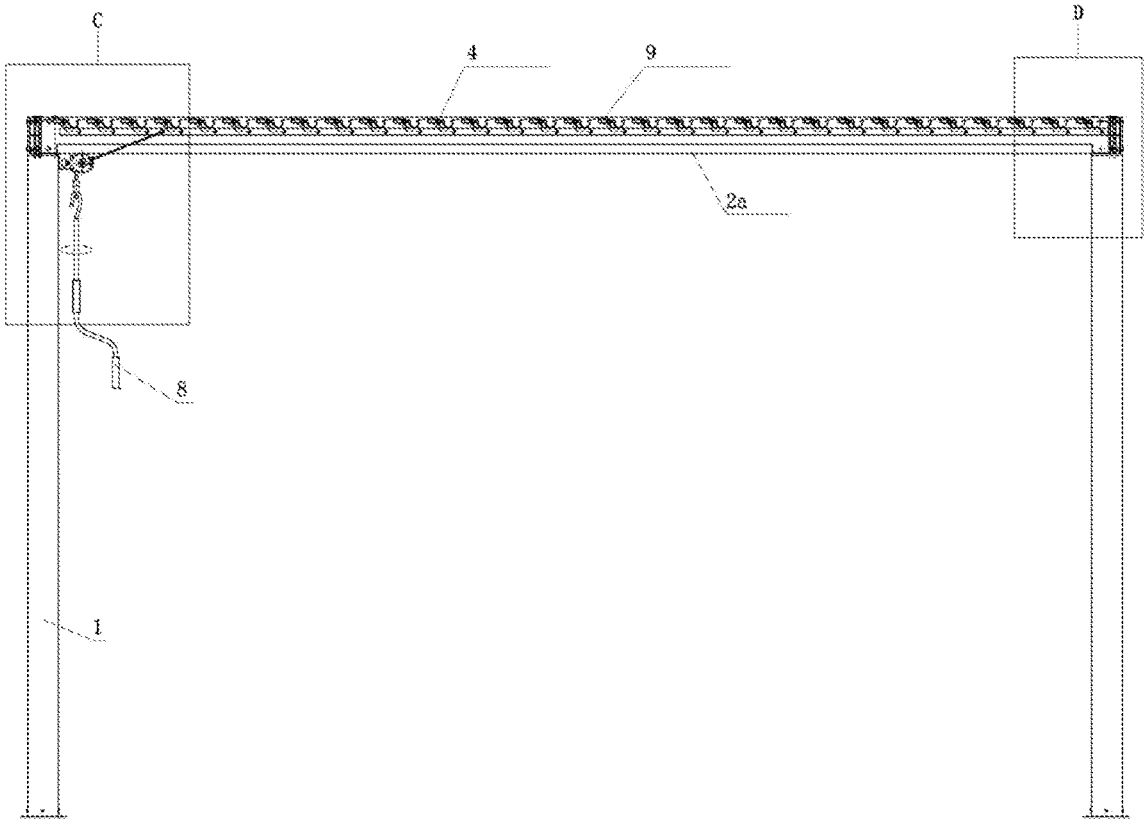
FIG. 7 is another second front-view structural schematic diagram of the present invention.
Figure 8:
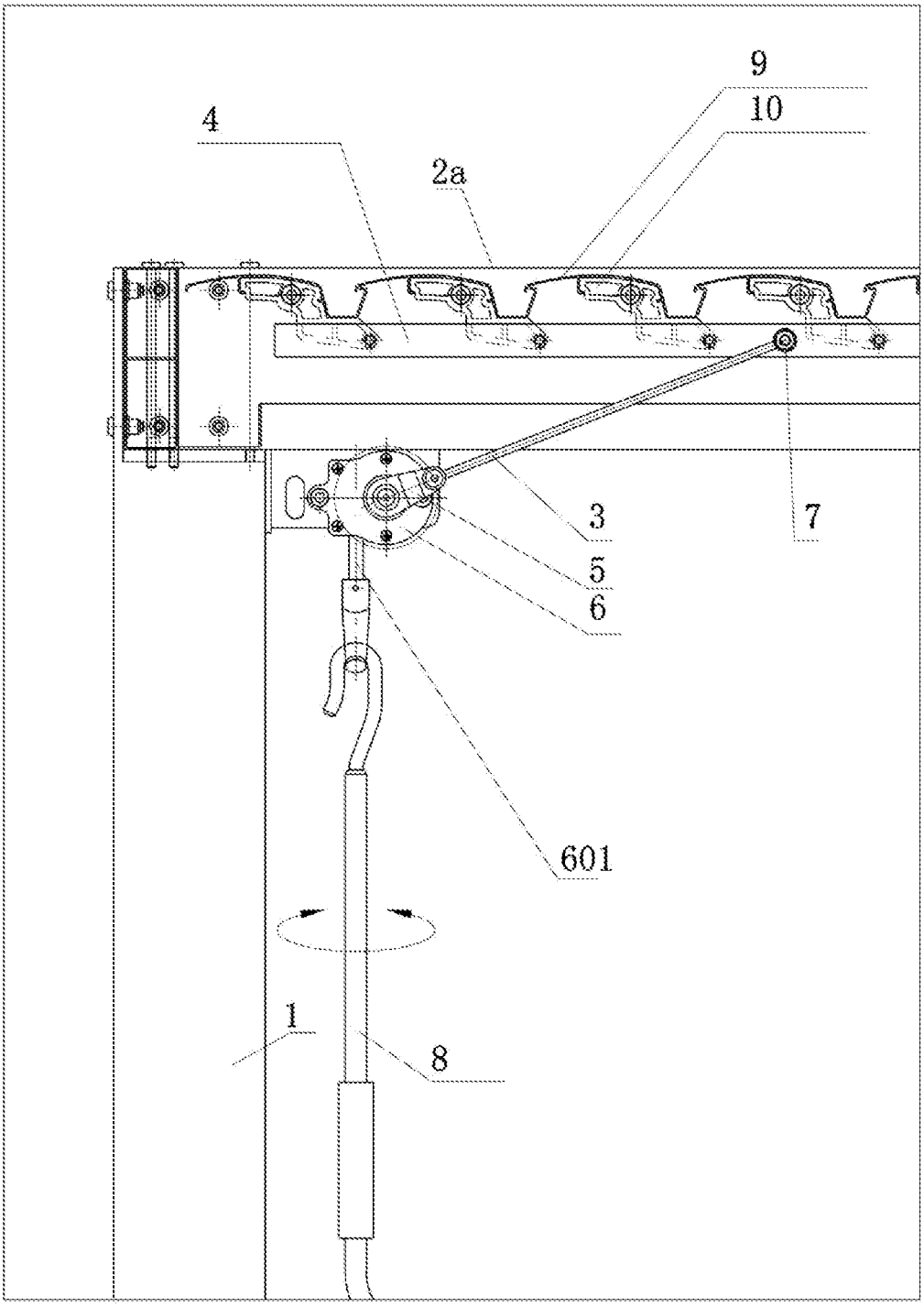
FIG. 8 is an enlarged diagram of region C in FIG. 7.
Figure 9:
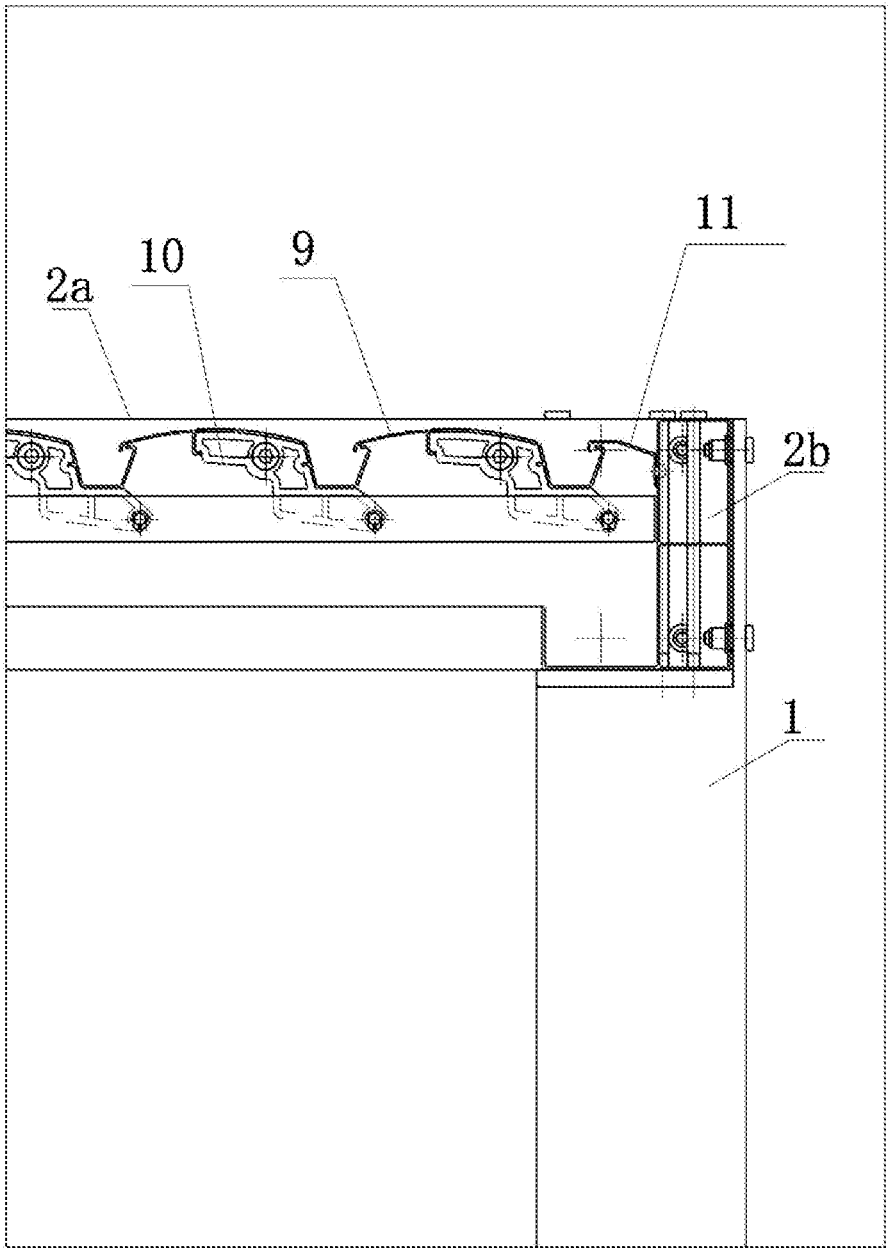
FIG. 9 is an enlarged diagram of region D in FIG. 7.
Figure 10:
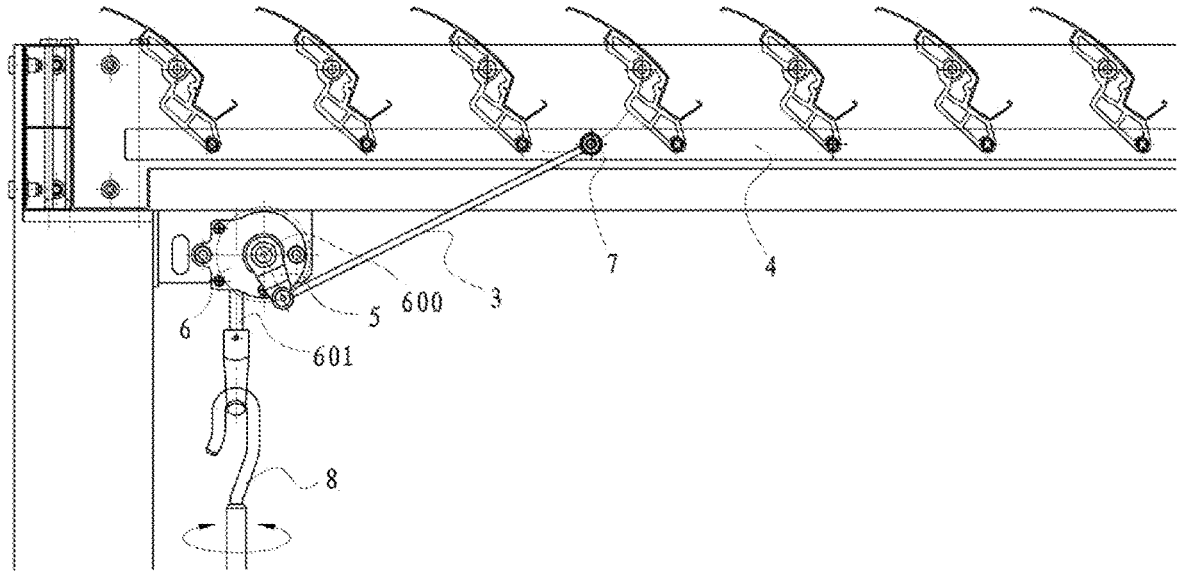
FIG. 10 is a schematic diagram of a working state of a driving mechanism in the present invention when a blade top plate is half opened.
Figure 11:
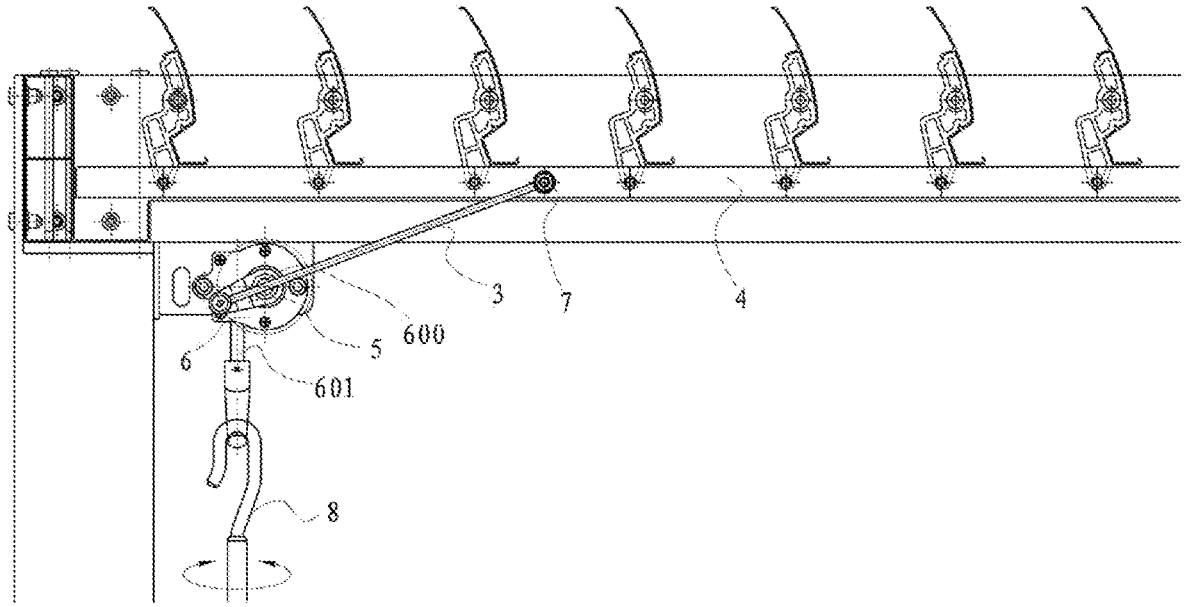
FIG. 11 is another schematic diagram of the working state of the driving mechanism in the present invention when the blade top plate is completely opened.
Figure 12:
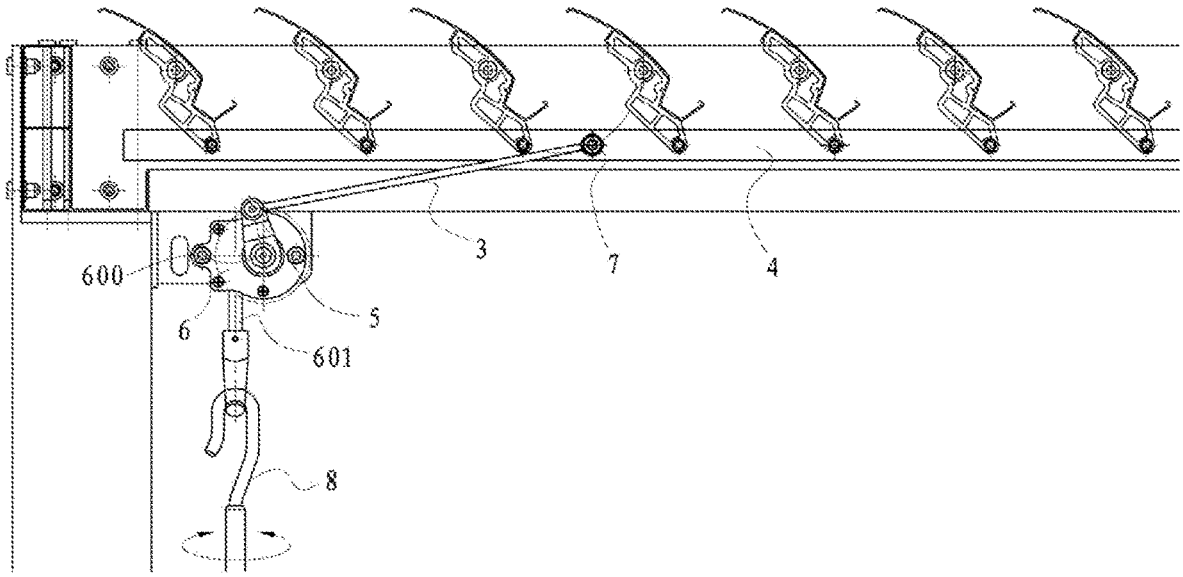
FIG. 12 is another schematic diagram of the working state of the driving mechanism in the present invention when the blade top plate is half opened.
Figure 13:
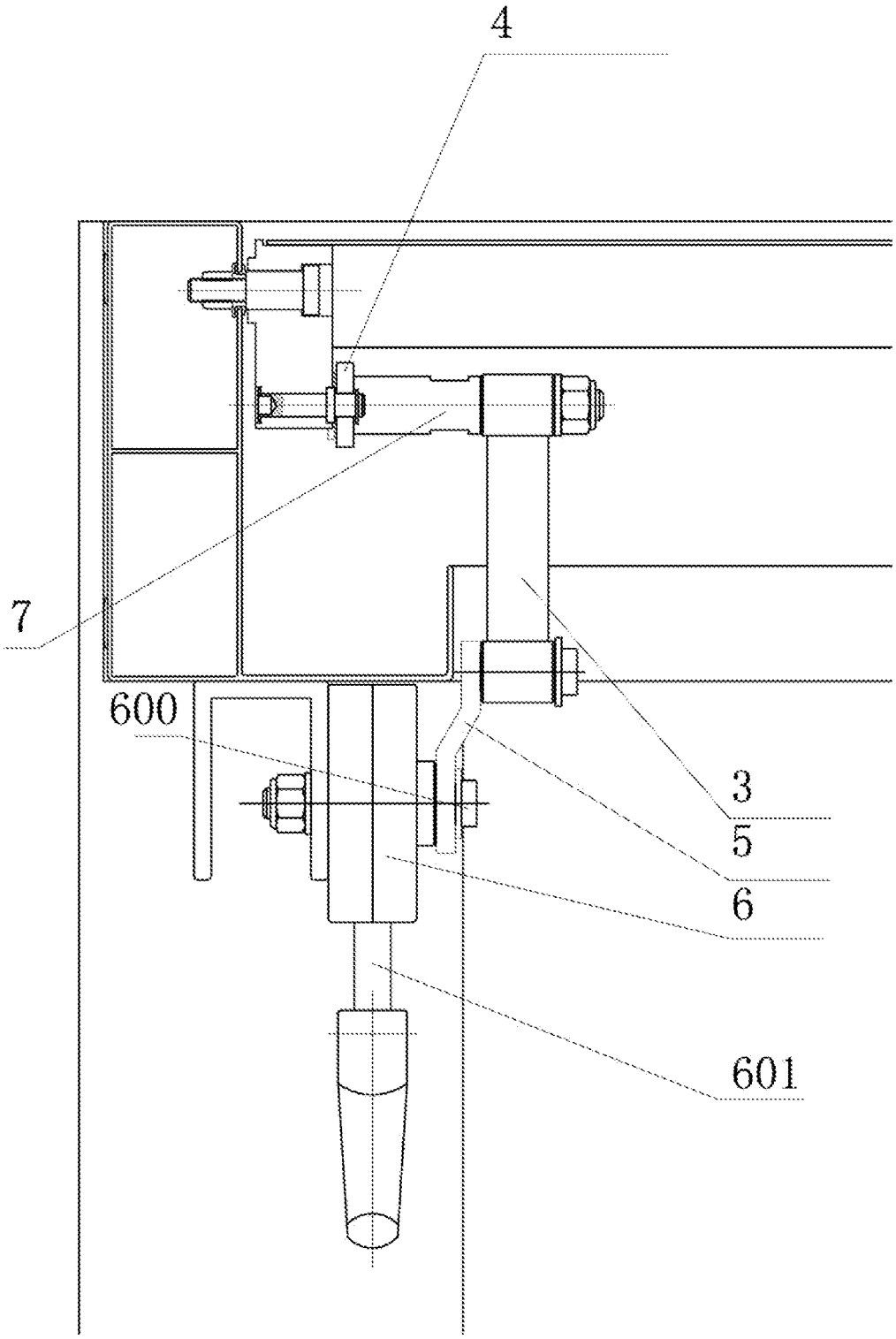
FIG. 13 is a left-view structural schematic diagram of the driving mechanism in the present invention.
Figure 14:
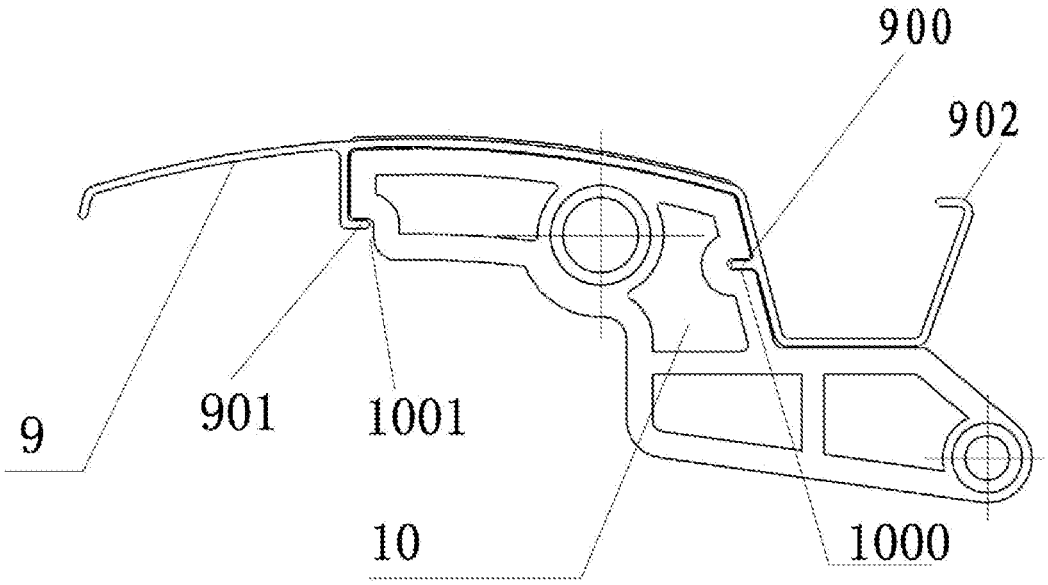
FIG. 14 is a structural schematic diagram of connection between the blade top plate and a blade end cover in the present invention.

FIG. 6 shows end surface structures of the first ring beam 2*a* and the beam water groove 200, and FIG. 3 can be referred to regarding end surface structures of the second ring beam 2*b* and the corresponding beam water groove 200.

As a structural optimization of the awning frame in the present invention: inner ends of the two ring beams abut against each other, and the inner ends are ends facing the stand column 1.

The above optimized structure is further described as follows. The inner ends of the two ring beams abut against each other by means of arranged inclined planes 201, inner ends of the beam water grooves 200 of the two ring beams also abut against each other by means of inclined planes, and an opening corresponding to the water falling opening 1000 is formed among the two beam water grooves 200, the first ring beam 2*a* and the second ring beam 2*b*. In addition, an abutting structure between the two ring beams can also be designed into a step-shaped buckling structure.

For shielding a gap between the rightmost blade top plate 9 and the right second ring beam 2*b*, a water retaining strip 11 is cooperatively mounted on the second ring beam 2*b*, and the water retaining strip 11 is just buckled on the water collection groove 902 of the blade top plate 9.

According to the present invention, the ring beam and the stand column are fastened in the horizontal direction by means of the screws and in the vertical direction by means of the screws, the connection reliability between the ring beam and the stand column is enhanced by means of the double-fastening structure, no angle iron and other structures need to be additionally arranged, and therefore, the present invention has the advantages of being reliable in connection, convenient to mount and capable of saving cost.

A working process of the present invention is as follows. The manual rocker 8 rotates forwards or reversely, and the manual rocker 8 drives the worm and gear assembly 6 to work. The worm and gear assembly 6 drives the rocker arm 5 to rotate, the rocker arm 5 drives the connection rod 3 to rotate, and the connection rod 3 drives the linkage strip 4 to move by means of the connection rod shaft 7. Then, the linkage strip 4 drives the blade top plate to be opened/closed, the rocker arm 5, the connection rod and the linkage strip 4 form a mechanism similar to a driving slide block, and the rocker arm 5 can continuously rotate by 360 degrees around the worm and gear assembly 6, such that the blade top plate is continuously opened/closed. The manual rocker 8 does not need to be rotated in a reverse direction when the blade top plate is to be closed, such that the blade top plate can be prevented from being damaged during closing. The present invention can be opened/closed whether forward rotation or reverse rotation, which is quite smooth and practical.

In another embodiment of the present invention, the power source may be an electric motor, and manual operation is replaced with electric operation, which saves more labor.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A multi-blade top awning capable of being opened/closed bidirectionally by 360 degrees, the multi-blade top awning comprising an awning frame, wherein a blade top plate, a linkage strip used for driving the blade top plate to be opened/closed and a driving mechanism are cooperatively mounted on the awning frame, the driving mechanism comprises a connection rod, a rocker arm, a worm and gear assembly and a power source, the connection rod is used for driving the linkage strip to move, the rocker arm is used for driving the connection rod to move, the worm and gear assembly is used for driving the rocker arm to rotate, and the power source is used for providing power for the worm and gear assembly; the rocker arm is able to drive the connection rod to reciprocate by one-way continuous rotation so as to open/close the blade top plate; and when the rocker arm and the connection rod are in a parallel or overlapped state, the blade top plate is completely opened or completely closed, wherein the awning frame comprises a plurality of stand columns and a ring beam set cooperatively mounted at upper ends of the stand columns, the ring beam set comprises first ring beams at front and rear ends of the awning frame and second ring beams at left and right ends of the awning frame, and each of the stand columns and the corresponding first ring beam and/or second ring beam are cooperatively mounted by fasteners in a horizontal direction and a vertical direction.

2. The multi-blade top awning capable of being opened/closed bidirectionally by 360 degrees according to claim 1, wherein one end of the connection rod is rotatably mounted on the linkage strip, the other end of the connection rod is rotatably mounted on the rocker arm, and the rocker arm is in transmission fit with an output shaft of the worm and gear assembly.

3. The multi-blade top awning capable of being opened/closed bidirectionally by 360 degrees according to claim 2, wherein the connection rod is rotatably mounted on the linkage strip by a connection rod shaft arranged on the connection rod.

4. The multi-blade top awning capable of being opened/closed bidirectionally by 360 degrees according to claim 3, wherein a first mounting plate and a second mounting plate fixedly match an end plate of each of the stand columns, the corresponding first and second ring beams and the end plate of each of the stand column are cooperatively mounted by vertically-arranged screws, a side surface of the first ring beam and the first mounting plate are cooperatively mounted by horizontally-arranged screws, and a side surface of the second ring beam and the second mounting plate are cooperatively mounted by the horizontally-arranged screws.

5. The multi-blade top awning capable of being opened/closed bidirectionally by 360 degrees according to claim 3, wherein the first ring beam and/or the second ring beam is fixedly provided with a beam water groove, and the beam water groove and the stand column are cooperatively mounted by the fasteners; and the end plate of each of the stand columns is provided with a water falling opening corresponding to the beam water groove.

6. The multi-blade top awning capable of being opened/closed bidirectionally by 360 degrees according to claim 2, wherein a first mounting plate and a second mounting plate fixedly match an end plate of each of the stand columns, the corresponding first and second ring beams and the end plate of each of the stand column are cooperatively mounted by vertically-arranged screws, a side surface of the first ring beam and the first mounting plate are cooperatively mounted by horizontally-arranged screws, and a side surface of the second ring beam and the second mounting plate are cooperatively mounted by the horizontally-arranged screws.

7. The multi-blade top awning capable of being opened/closed bidirectionally by 360 degrees according to claim 2, wherein the first ring beam and/or the second ring beam is fixedly provided with a beam water groove, and the beam water groove and the stand column are cooperatively mounted by the fasteners; and the end plate of each of the stand columns is provided with a water falling opening corresponding to the beam water groove.

8. The multi-blade top awning capable of being opened/closed bidirectionally by 360 degrees according to claim 2, wherein a blade end cover is cooperatively mounted at an end part of the blade top plate, one end of the blade end cover is rotatably mounted on the awning frame, and the other end of the blade end cover is rotatably mounted on the linkage strip; and a water retaining strip is cooperatively mounted on one side of an upper end of the awning frame.

9. The multi-blade top awning capable of being opened/closed bidirectionally by 360 degrees according to claim 1, wherein when an angle between the rocker arm and the connection rod is 0 degree, the connection rod drives the blade top plate to be in a completely opened state by the linkage strip; and when the angle between the rocker arm and the connection rod is 180 degrees, the connection rod drives the blade top plate to be in a completely closed state by the linkage strip.

10. The multi-blade top awning capable of being opened/closed bidirectionally by 360 degrees according to claim 9, wherein a first mounting plate and a second mounting plate fixedly match an end plate of each of the stand columns, the corresponding first and second ring beams and the end plate of each of the stand column are cooperatively mounted by vertically-arranged screws, a side surface of the first ring beam and the first mounting plate are cooperatively mounted by horizontally-arranged screws, and a side surface of the second ring beam and the second mounting plate are cooperatively mounted by the horizontally-arranged screws.

11. The multi-blade top awning capable of being opened/closed bidirectionally by 360 degrees according to claim 9, wherein the first ring beam and/or the second ring beam is fixedly provided with a beam water groove, and the beam water groove and the stand column are cooperatively mounted by the fasteners; and the end plate of each of the stand columns is provided with a water falling opening corresponding to the beam water groove.

12. The multi-blade top awning capable of being opened/closed bidirectionally by 360 degrees according to claim 1, wherein a first mounting plate and a second mounting plate fixedly match an end plate of each of the stand columns, the corresponding first and second ring beams and the end plate of each of the stand column are cooperatively mounted by vertically-arranged screws, a side surface of the first ring beam and the first mounting plate are cooperatively mounted by horizontally-arranged screws, and a side surface of the second ring beam and the second mounting plate are cooperatively mounted by the horizontally-arranged screws.

13. The multi-blade top awning capable of being opened/closed bidirectionally by 360 degrees according to claim 1, wherein the first ring beam and/or the second ring beam is fixedly provided with a beam water groove, and the beam water groove and the stand column are cooperatively mounted by the fasteners; and the end plate of each of the stand columns is provided with a water falling opening corresponding to the beam water groove.

14. The multi-blade top awning capable of being opened/closed bidirectionally by 360 degrees according to claim 13, wherein the beam water groove and the end plate of each of the stand columns are cooperatively mounted by the vertically-arranged screws.

15. The multi-blade top awning capable of being opened/closed bidirectionally by 360 degrees according to claim 1, wherein inner ends of the first ring beam and the second ring beam abut against each other.

16. The multi-blade top awning capable of being opened/closed bidirectionally by 360 degrees according to claim 1, wherein a blade end cover is cooperatively mounted at an end part of the blade top plate, one end of the blade end cover is rotatably mounted on the awning frame, and the other end of the blade end cover is rotatably mounted on the linkage strip; and a water retaining strip is cooperatively mounted on one side of an upper end of the awning frame.

* * * * *